US008878454B2

(12) United States Patent
Rix et al.

(10) Patent No.: US 8,878,454 B2
(45) Date of Patent: Nov. 4, 2014

(54) SOLID STATE LIGHTING SYSTEM

(75) Inventors: Robert D. Rix, Hershey, PA (US); Ronald Martin Weber, Annville, PA (US); Charles Raymond Gingrich, III, Mechanicsburg, PA (US); Matthew Edward Mostoller, Hummelstown, PA (US); Christopher George Daily, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 924 days.

(21) Appl. No.: 12/634,492

(22) Filed: Dec. 9, 2009

(65) Prior Publication Data

US 2011/0133668 A1 Jun. 9, 2011

(51) Int. Cl.
*H05B 37/02* (2006.01)

(52) U.S. Cl.
CPC ..... *H05B 37/0245* (2013.01)
USPC ..... 315/294; 315/291; 362/249.02

(58) Field of Classification Search
USPC ..... 315/294, 291, 312, 246; 362/249, 362/249.02
See application file for complete search history.

(56) References Cited

U.S. PATENT DOCUMENTS

| | | | |
|---|---|---|---|
| 5,038,255 | A | 8/1991 | Nishihashi et al. |
| 5,283,716 | A | 2/1994 | Banitt et al. |
| 5,404,282 | A | 4/1995 | Klinke et al. |
| 5,660,461 | A | 8/1997 | Ignatius et al. |
| 6,318,886 | B1 | 11/2001 | Stopa et al. |
| 6,541,800 | B2 | 4/2003 | Barnett et al. |
| 6,548,967 | B1 | 4/2003 | Dowling et al. |
| 6,667,544 | B1 | 12/2003 | Glenn |
| 6,817,735 | B2 | 11/2004 | Shimizu et al. |
| 6,911,731 | B2 | 6/2005 | Wu |
| 6,999,318 | B2 | 2/2006 | Newby |
| 7,042,745 | B1 * | 5/2006 | Chen ..... 363/144 |
| 7,306,353 | B2 | 12/2007 | Popovich et al. |

(Continued)

FOREIGN PATENT DOCUMENTS

| | | |
|---|---|---|
| DE | 19818402 | 10/1999 |
| DE | 10319525 | 11/2004 |
| EP | 10981355 | 5/2001 |
| WO | WO 0173844 | 10/2001 |

OTHER PUBLICATIONS

European Search Report, Mail Date Apr. 18, 2011, EP 10 19 3865, Application No. 10193865.2-2206.

*Primary Examiner* — Jimmy Vu
*Assistant Examiner* — Amy Yang

(57) ABSTRACT

A solid state lighting system includes an electronic driver having a power input configured to receive power from a power source and the electronic driver having a power output. The electronic driver controls the power supply to the power output according to a control protocol, and the electronic driver has at least one expansion port having a separable interface. The system also includes a light emitting diode (LED) subassembly having an LED board having at least one LED that receives power from the power output of the electronic driver to power the LED. The system further includes a first expansion module configured to be coupled to the at least one expansion port of the electronic driver having a first functionality affecting the control protocol, and a second expansion module configured to be coupled to the at least one expansion port of the electronic driver having a second functionality affecting the control protocol. The first and second expansion modules are selectively coupled to the at least one expansion port to change the control protocol.

19 Claims, 7 Drawing Sheets

(56) References Cited

U.S. PATENT DOCUMENTS

| | | | | |
|---|---|---|---|---|
| 7,322,718 | B2 | 1/2008 | Setomoto et al. | |
| 7,348,604 | B2 | 3/2008 | Matheson | |
| 7,400,029 | B2 | 7/2008 | Shimada et al. | |
| 7,425,757 | B2 * | 9/2008 | Takubo | 257/678 |
| 7,540,761 | B2 | 6/2009 | Weber et al. | |
| 7,549,786 | B2 | 6/2009 | Higley et al. | |
| 7,553,162 | B2 | 6/2009 | Isoda et al. | |
| 2002/0113244 | A1 | 8/2002 | Barnett et al. | |
| 2002/0114155 | A1 | 8/2002 | Katogi et al. | |
| 2002/0176250 | A1 | 11/2002 | Bohler et al. | |
| 2003/0063463 | A1 * | 4/2003 | Sloan et al. | 362/238 |
| 2003/0094893 | A1 | 5/2003 | Ellens et al. | |
| 2003/0112627 | A1 | 6/2003 | Deese | |
| 2003/0189829 | A1 | 10/2003 | Shimizu et al. | |
| 2004/0140776 | A1 | 7/2004 | Fleischmann et al. | |
| 2004/0175189 | A1 | 9/2004 | Weber-Rabsilber et al. | |
| 2004/0252501 | A1 | 12/2004 | Moriyama et al. | |
| 2004/0264195 | A1 | 12/2004 | Chang et al. | |
| 2005/0152146 | A1 | 7/2005 | Owen et al. | |
| 2005/0243558 | A1 | 11/2005 | Van Duyn | |
| 2006/0091410 | A1 | 5/2006 | Chen | |
| 2006/0244622 | A1 * | 11/2006 | Wray | 340/815.45 |
| 2006/0262533 | A1 | 11/2006 | Lin et al. | |
| 2006/0262544 | A1 | 11/2006 | Piepgras et al. | |
| 2007/0025103 | A1 | 2/2007 | Chan | |
| 2007/0246712 | A1 | 10/2007 | Kim et al. | |
| 2008/0136334 | A1 * | 6/2008 | Robinson et al. | 315/151 |
| 2008/0220631 | A1 | 9/2008 | Isoda et al. | |
| 2008/0315214 | A1 | 12/2008 | Wall, Jr. et al. | |
| 2009/0009103 | A1 | 1/2009 | McKenchnie et al. | |
| 2009/0009998 | A1 | 1/2009 | Malstrom et al. | |
| 2009/0108281 | A1 | 4/2009 | Keller et al. | |
| 2009/0130889 | A1 | 5/2009 | Daily et al. | |
| 2009/0146919 | A1 | 6/2009 | Kline et al. | |
| 2009/0147028 | A1 * | 6/2009 | Sefton et al. | 345/690 |

* cited by examiner

SOLID STATE LIGHTING SYSTEM

CROSS REFERENCE TO RELATED APPLICATIONS

This Application Relates to U.S. patent application Ser. Nos. 12/634,416, 12/634,453, 12/634,517, and 12/634,542 each filed concurrently herewith, the subject matter of each of which are herein incorporated by reference in their entirety.

BACKGROUND OF THE INVENTION

The subject matter herein relates generally to solid state lighting systems, and more particularly, to configurable solid state lighting systems.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

Solid-state lighting systems typically include different components that are assembled together to complete the final system. For example, the system typically consists of a driver, a controller, a light source, and a power supply. It is not uncommon for a customer assembling a lighting system to have to go to many different suppliers for each of the individual components, and then assemble the different components, from different manufacturers together. Purchasing the various components from different sources proves to make integration into a functioning system difficult. This non-integrated approach does not allow the ability to effectively package the final lighting system in a lighting fixture efficiently.

Another problem with known solid state lighting systems is that the components are typically customized for a particular end use application. For example, to achieve certain functionality, the driver will either be custom manufactured for one particular functionality, such as wireless control, dimming capability, programmable set points, and the like. As such, different drivers must be purchased and/or stored by the customer, and the appropriate driver must be selected depending on the desired end use. Furthermore, if the needs or functionality of the lighting system were to change, then the entire driver would need to be removed and replaced. Alternatively, the driver may be over designed such that the driver has multiple functionality, which may or may not be required for the particular end use application. In such situation, the over design of the driver adds to the overall cost of the driver, and the customer may not have need for certain functionality leading the customer to overpay for functionality of the driver that is not needed or wanted.

A need remains for a lighting system that may be efficiently packaged into a lighting fixture. A need remains for a lighting system that may be efficiently configured for an end use application.

BRIEF DESCRIPTION OF THE INVENTION

In one embodiment, a solid state lighting system is provided including an electronic driver having a power input configured to receive power from a power source and the electronic driver having a power output. The electronic driver controls the power supply to the power output according to a control protocol, and the electronic driver has at least one expansion port having a separable interface. The system also includes a light emitting diode (LED) subassembly having an LED board having at least one LED that receives power from the power output of the electronic driver to power the LED. The system further includes a first expansion module configured to be coupled to the at least one expansion port of the electronic driver having a first functionality affecting the control protocol, and a second expansion module configured to be coupled to the at least one expansion port of the electronic driver having a second functionality affecting the control protocol. The first and second expansion modules are selectively coupled to the at least one expansion port to change the control protocol. Optionally, the first and second expansion modules may be swappable such that either the first expansion module or the second expansion module may be coupled to any of the at least one expansion port to change the control protocol.

In another embodiment, a solid state lighting system is provided that includes an expandable electronic driver having a driver printed circuit board (PCB), a power input configured to receive power from a power supply circuit, and a power output. The electronic driver controls the power supply to the power output according to a control protocol, and the electronic driver has a first expansion port having a separable interface. The system also includes a light emitting diode (LED) subassembly comprising an LED board having at least one LED that receives power from the power output of the electronic driver to power the LED. The system further includes a first expansion module pluggably coupled to the first expansion port, that has a first expansion module PCB having a first control circuit operatively coupled to the driver PCB by the first expansion port. The first control circuit affects the control protocol when the first expansion module is plugged into the first expansion port. The first expansion module is removable from the first expansion port such that the first control circuit is not operatively coupled to the driver PCB, wherein the electronic driver is operable in a basic mode when the first expansion module is removed from the first expansion module, and wherein the electronic driver is operable in an enhanced control mode when the first expansion module is pluggably coupled to the first expansion port. The control protocol is different in the basic mode and the enhanced control mode.

In a further embodiment, a solid state lighting system is provided that includes an expandable electronic driver having a driver printed circuit board (PCB) forming a driver power circuit, a power input configured to receive power from a power supply circuit, and a power output. The system also includes a light emitting diode (LED) subassembly comprising an LED board having at least one LED that receives power from the power output of the driver power circuit to power the LED. The system further includes a first expansion module pluggably coupled to the electronic driver that has a first expansion module PCB having a filtering circuit being tapped into one of the power supply circuit and the driver power circuit. The first expansion module is removable from the electronic driver such that the filtering circuit is not tapped into either of the power supply circuit or the driver power circuit, wherein the electronic driver is operable in a filtered mode when the first expansion module is pluggably coupled to the electronic driver and wherein the electronic driver is operable in an unfiltered mode when the first expansion module is removed from the electronic driver. The power characteristics of the driver power circuit are different when the electronic driver is operated in the filtered mode than when the electronic driver is operated in the unfiltered mode.

DETAILED DESCRIPTION OF THE INVENTION

Figure 1:
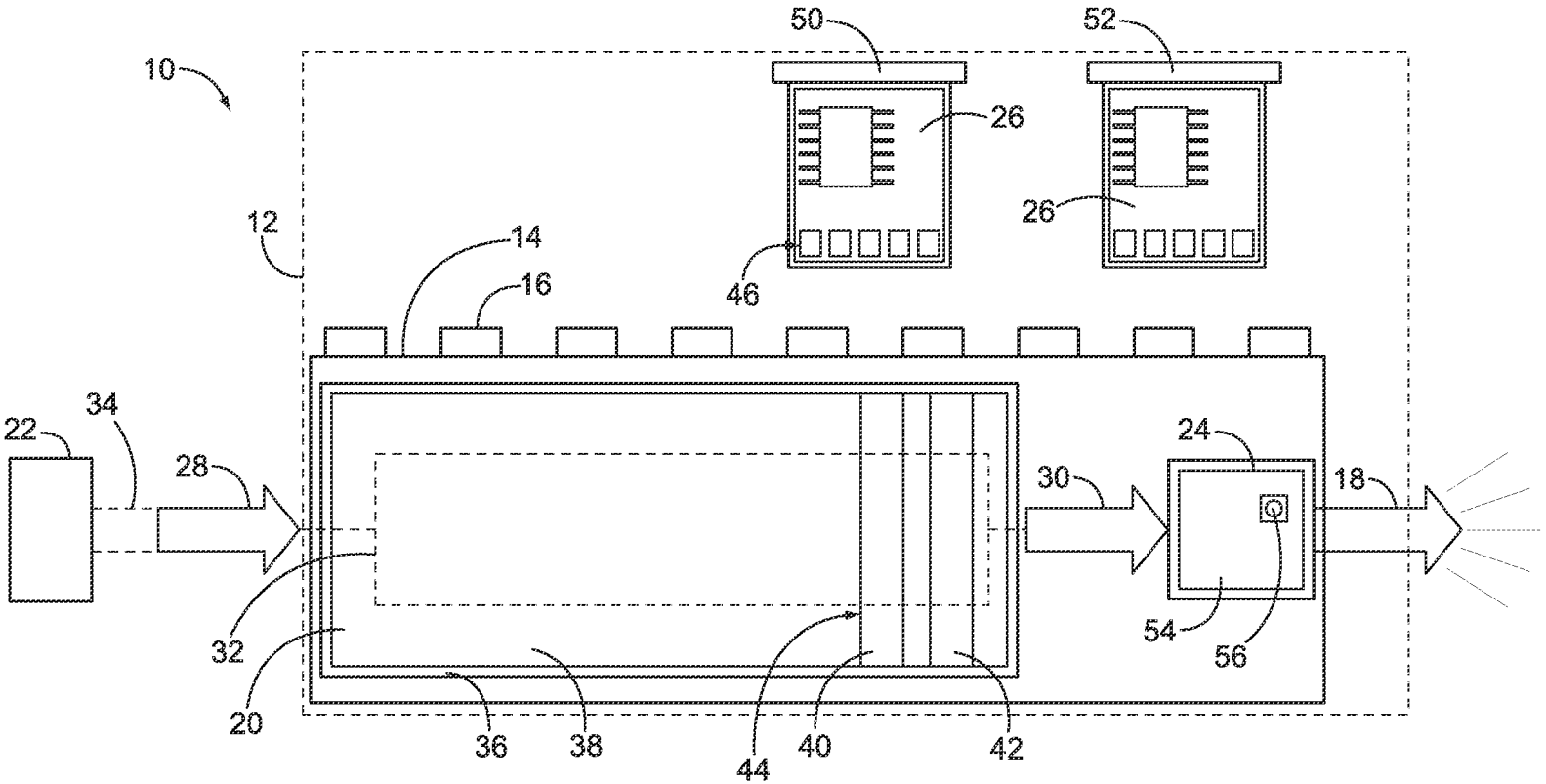
FIG. 1 is a block diagram of a solid state lighting system for a lighting fixture.

FIG. 1 is a block diagram of a solid state lighting system 10 for a lighting fixture 12. The lighting fixture 12 generally includes a base 14 that supports the various components of the system 10. The base 14 may include or may constitute a heat sink 16 for dissipating heat generated by the components of the system 10. The system 10 produces light 18 for the lighting fixture 12. In an exemplary embodiment, the lighting fixture 12 is a light engine that is used for residential, commercial or industrial use. The lighting fixture 12 may be used for general purpose lighting, or alternatively, may have a customized application or end use.

The system 10 includes an electronic driver 20 that receives power from a power source 22, a light emitting diode (LED) subassembly 24 that receives power from the electronic driver 20, and one or more expansion modules 26 that control the electronic driver 20, as described in further detail below. The electronic driver 20 receives a line voltage from the power source 22, indicated by the power input 28. The line voltage may be AC or DC power. The power source 22 may be an electrical outlet, a junction box, a battery, a photovoltaic source, and the like. The electronic driver 20 takes the power from the power source 22, such as 85-277VAC and outputs a power output 30 to the LED subassembly 24. In an exemplary embodiment, the electronic driver 20 outputs a constant current to the LED subassembly 24, such as 350 mA of constant current.

The electronic driver 20 controls the power supply to the power output 30 according to a control protocol. The electronic driver 20 includes a driver power circuit 32 including the power input 28 and the power output 30. The power input 28, and thus the driver power circuit 32, receives power from a power supply circuit 34 that connects the power source 22 with the system 10. In an exemplary embodiment, the electronic driver 20 includes a housing 36 that holds a driver PCB 38. The driver power circuit 32 is a circuit formed by the driver PCB 38. The driver PCB 38 may have other circuits also.

In a basic mode, the control protocol uses the driver power circuit 32 to convert the power input 28 to the power output 30, such as to a constant current. In a filter mode, the control protocol uses components of the system 10 to filter the power, for example, filtering noise from the input line, filtering for power factor correction, filtering for rectification, such as between AC and DC power, and the like. Such filtering may be performed to meet certain standards such as energy star standards, FCC interference standards, and the like. For example, the filtering may prevent the driver circuit from feeding back undesired effects to the power supply line. In a circuit protection mode, the control protocol uses components of the system 10 to protect the driver power circuit 32, other components of the electrical driver 20, the LED subassembly 24, the expansion module(s) 26 and/or the power supply circuit 34. In an enhanced control mode, the control protocol uses components of the system 10 to provide enhanced controls. For example, the control protocol may be controlled wirelessly, according to a building control program, according to programmable set points, using daylight harvesting, using dim control, using occupancy control, using emergency light control, using battery back up, and the like. Such enhanced controls may be part of the expansion module (s) 26 rather than controls that are built into the electronic driver 20.

The electronic driver 20 may include components that allow for operation in the basic mode, only. The enhanced mode(s) are controlled based on the presence of particular expansion modules 26 having features and components that allow such functionality. As such, the electronic driver 20 may be configurable or expandable by simply adding or changing the expansion modules 26 operatively coupled to the electronic driver 20. Any number of expansion modules 26 may be added to the electronic driver 20 as add-ons to change the functionality and control protocol depending on the particular application and desired functionality. The expansion modules 26 may include features and components that control one or more functions. The expansion modules 26 are selectively useable with the electronic driver 20 and may be easily and readily mated and unmated or swapped in or out to change the control protocol. In addition, the expansion modules 26 may allow functionality for the filtering mode and/or the circuit protection mode. For example, the expansion modules 26 may include features and components that provide the filtering or the circuit protection. Alternatively, the electronic driver 20 may have the functionality of the filtering mode and/or the circuit protection mode built in using certain components tied into the driver power circuit 32 or other circuits integral to the electronic driver 20. In such case, the filtering and circuit protection features and components are considered integral to the electronic driver 20 and are not swappable or removable.

FIG. 1 illustrates the electronic driver 20 to have a first expansion port 40 and a second expansion port 42. The expansion ports 40, 42 are configured to removably interface with expansion modules 26 to electrically connect the expansion modules 26 to the electronic driver 20. For example, the expansion ports 40, 42 may include separable interfaces 44 that non-permanently mate with a corresponding mating interface 46 of one of the expansion modules 26. The expansion ports 40, 42 are illustrated as being integral with or as part of the driver PCB 38, however, it is realized that the expansion ports 40, 42 may be part of the driver housing 36.

For example, the expansion ports 40, 42 may include connectors or receptacles in the housing 36 that interface with the driver PCB 38 or that allow the expansion modules 26 to interface with the driver PCB 38 therethrough.

In an exemplary embodiment, the expansion ports 40, 42 may receive multiple different types of expansion modules 26. For example, the mating interfaces 46 of each of the different kinds (e.g. each kind having different functionality) of expansion modules 26 may be similar or the same such that any expansion module 26 may mate with any expansion port 40, 42. It is realized that the electronic driver 20 may have any practical number of expansion ports to accommodate different configurations of expansion modules 26. Additionally, it is realized that any of the expansion ports 46 may be kept open (e.g. no expansion module 26 mated thereto), which would have no affect on the control protocol. As such, if all of the expansion ports 46 were kept open, then the electronic driver 20 would operate in the basic mode (or the filter mode or circuit protection mode if either of those corresponding components were integral to the electronic driver 20).

In an exemplary embodiment, the electronic driver 20 is mounted to the base 14 and/or heat sink 16, in a semi-permanent or a permanent manner, such as using fasteners, adhesives, epoxy, and the like. The expansion modules 26 may be coupled to, and then removed, repaired and/or replaced separate from the electronic driver 20. For example, the expansion modules 26 may be removed and/or mated without removing the electronic driver 20 from the base 14 and/or heat sink 16. As such, the electronic driver 20 may be modified, changed, upgraded and/or downgraded in situ quickly and efficiently.

In the illustrated embodiment, the system 10 includes a first expansion module 50 and a second expansion module 52. The first expansion module 50 has a first functionality that is configured to affect the control protocol in a first manner (e.g. wireless control), and the second expansion module 52 has a second functionality configured to affect the control protocol in a second manner (e.g. dimmer control). The first and second expansion modules 50, 52 are selectively coupled to the first and second expansion ports 40, 42, shown by the arrows representing the expansion modules 50, 52 being mated with the expansion ports 40, 42. When mated, the expansion modules 50, 52 will change the control protocol of the electronic driver 20. The first and second expansion modules 50, 52 are swappable such that the first expansion module 50 may be mated with the second expansion port 42 and the second expansion module 52 may be mated with the first expansion port 40. The first and second expansion modules 50, 52 are also swappable with other expansion modules (not shown) having different functionality that affect the control protocol in different ways than the first and second expansion modules 50, 52.

The LED subassembly 24 includes an LED PCB 54 having at least one LED 56 thereon. The LED 56 creates the light 18. The LED PCB 54 receives power from the power output 30 of the electronic driver 20 to power the LED 56. Optionally, the LED subassembly 24 may include multiple LED PCBs 54 that are ganged or daisy chained together. The LED PCBs 54 may be arranged adjacent one another, or alternatively, may be spread apart and electrically interconnected by a wire harness. Optionally, the LED subassembly 24 may be mounted to the base 14. Alternatively, the LED subassembly 24 may be mounted remote from the base 14 and electrically connected thereto, such as by a wired connection.

Figure 2:
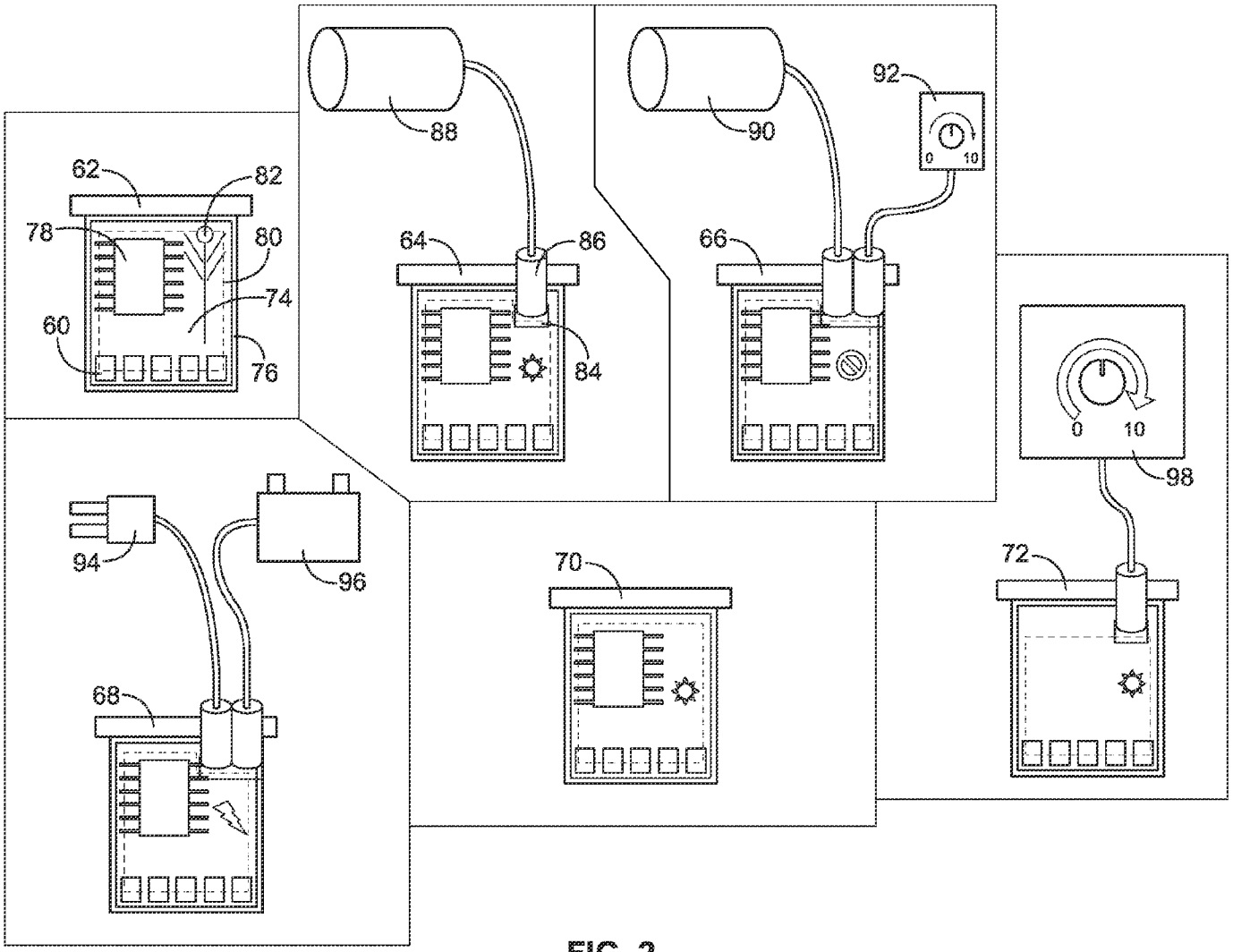
FIG. 2 illustrates exemplary expansion modules for use with the solid state lighting system shown in FIG. 1.

FIG. 2 illustrates exemplary expansion modules 26 for use with the solid state lighting system 10 (shown in FIG. 1). FIG. 2 shows different types of expansion modules 26 that have different functionality. It is realized that the expansion modules 26 illustrated in FIG. 2 are merely representative of exemplary embodiments of expansion modules 26 and other types of expansion modules 26 that have different functionality useful within the system 10 may be used in addition to, or in lieu of, the expansion modules 26 illustrated in FIG. 2. Furthermore, the expansion modules 26 are illustrated as being card-type modules that are pluggable into a card slot, however, it is realized that the expansion modules 26 may have any structural form that would allow mating and unmating with corresponding, complementary expansion ports. The expansion modules 26 are not intended to be limited to the structure illustrated in FIG. 2. For example, while the expansion modules 26 are illustrated as including multiple pads 60 for interfacing with the electronic driver 20 (shown in FIG. 1), it is realized that other types of connections may be made to the electronic driver 20, including, but not limited to, pins, electrical connectors, wires, and the like.

In the illustrated embodiment, the various expansion modules 26 include a first expansion module 62, representing a wireless control type module; a second expansion module 64, representing a light sensing type module, such as for daylight harvesting or dimming controls; a third expansion module 66, representing an occupancy type module; a fourth expansion module 68, representing an emergency light control type module; a fifth expansion module 70, representing a smart dim control type module; and a sixth expansion module 72, representing a basic remote dimming control type module.

The first expansion module 62 includes an expansion module PCB 74 held within an expansion module housing 76. The PCB 74 may be provided without the expansion module housing 76, such as by directly plugging the PCB 74 into a card slot in the electronic driver 20. The PCB 74 includes the pads 60 at an edge thereof. A microprocessor 78 is soldered to the PCB 74, which forms part of a control circuit 80 of the expansion module 62. The expansion module 62 also includes an antenna 82 forming part of the control circuit 80. The antenna 82 allows the expansion module 62 to send and/or receive signals wirelessly, such as to control the on/off or dimming level of the system 10. The control circuit 80 is electrically connected to, and thus communicates with, the electronic driver 20 via the pads 60 when the expansion module 62 is mated therewith. The electronic driver 20 may thus be controlled by the removable expansion module 62, by changing the control protocol based on a status of the control circuit 80.

Most of the other expansion modules 64-72 illustrated in FIG. 2 include similar features as the expansion module 62 of a PCB, an expansion module housing, pads, a microprocessor, and a control circuit. However, rather than the antenna 82, the other expansion modules 64-72 include other components that relate to the specific functionality of the particular expansion module 64-72. For example, the expansion module 64 includes a connector 84 that mates with a plug 86 attached to a remote light sensor 88. The remote light sensor 88 senses an amount of light, such as sunlight or light from other sources, in the vicinity of the system 10. Based on certain programmable set points, the control circuit may indicate to the electronic driver 20 to dim the lights or shut the lights off. The remote light sensor 88 represents an external device coupled to the expansion module 64 by the plug 86.

The expansion module 66 also includes connectors for plugs connected to a remote occupancy sensor 90 and a dimmer switch 92. The remote occupancy sensor 90 detects the presence of a particular object or person in the vicinity of the system 10, such as in the same room as the system 10, and the control circuit may indicate to the electronic driver 20 to turn on the lights or brighten the lights when the presence is detected. With the dimmer switch 92, the control circuit may indicate to the electronic driver 20 the lighting level required. For example, the dimmer switch 92 may be remote from the expansion module 66, such as on a wall in the room, and may include a dial or a slider to control the light level. The remote occupancy sensor 90 and a dimmer switch 92 both represent external devices coupled to the expansion module 66 by plugs.

The expansion module 68 includes connectors for plugs connected to a sensor 94 connected to a line circuit breaker configured to sense power loss to the system 10 and connected to a battery 96 or other backup power supply. When a power loss condition is detected by the sensor 94, the battery 96 may supply power to the system 10, either through the expansion module 68 or through a direct connection between the battery 96 and the electronic driver 20. If power is to be sent through the expansion module 68, at least some of the pads 60 would be used to connect the battery DC output to a DC rail or other power circuit of the electronic drivers 20. The sensor 94 and battery 96 both represent external devices coupled to the expansion module 68 by plugs.

The expansion module 70 is used to sense chopped AC input from a standard Triac wall dimmer. For example, some of the pads 60 would connect to the line or other power circuit of the electronic driver 20 so the microprocessor can analyze the input in the power circuit.

The expansion module 72 does not include a microprocessor. Rather, a remote dimmer 98 is connected to the control circuit of the expansion module 72. The control circuit then controls the electronic driver 20 to provide the appropriate level of lighting. Others of the expansion modules 62-70 may be used without a microprocessor. The remote dimmer 98 represents an external device coupled to the expansion module 72 by a plug.

Figure 3:
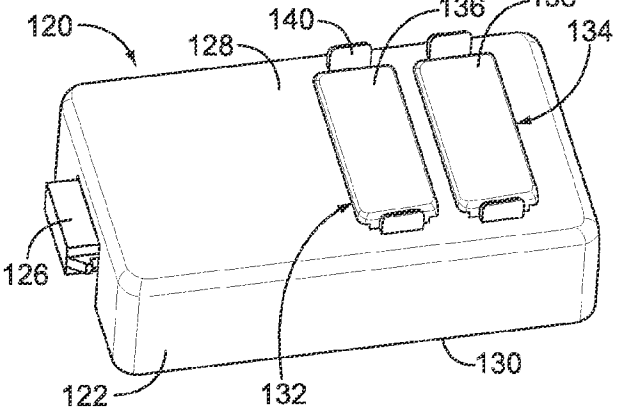
FIG. 3 is a top perspective view of an exemplary electronic driver for use in the solid state lighting system shown in FIG. 1.

FIG. 3 is a top perspective view of an exemplary electronic driver 120 for use in the solid state lighting system 10 (shown in FIG. 1). The electronic driver 120 includes a housing 122 holding a driver PCB 124 (shown in FIG. 4). The electronic driver 120 has a line in at a power input 126 from the power source 22. In the illustrated embodiment, the power input 126 is represented by a connector that is configured to mate with a plug at an end of a wire from the power source 22. The power input 126 is terminated to, or otherwise electrically connected to the driver PCB 124 to supply the power to the driver PCB 124. Optionally, a similar type of connector (not shown) may be provided at an opposite end of the housing 122 for a line out at the power output 30 to supply the power to the LED subassembly 24.

The housing 122 is generally box shaped, however the housing 122 may have any other shape in alternative embodiments, depending on the particular application. The housing 122 includes a top 128 and a bottom 130. The bottom 130 rests upon the base 14 and/or heatsink 16 (both shown in FIG. 1). The housing 122 includes a first expansion port 132 and a second expansion port 134. Any number of expansion ports may be provided in alternative embodiments. In the illustrated embodiment, the expansion ports 132, 134 are represented by openings or slots in the top 128 of the housing 122 that provide access to the driver PCB 124. When the expansion ports 132, 134 are not in use (e.g. not mated with an expansion module), caps 136, 138 are coupled to the expansion ports 132, 134 to cover the openings. The caps 136, 138 include latches 140 to secure the caps 136, 138 to the housing 122. The caps 136, 138 are removable by deflecting the latches 140 and pulling the caps 136, 138 out of the openings. Optionally, the caps 136, 138 may be tethered to the housing 122 such that, even when the caps 136, 138 are taken out of the expansion ports 132, 134, the caps 136, 138 remain attached to the housing 122.

Figure 4:
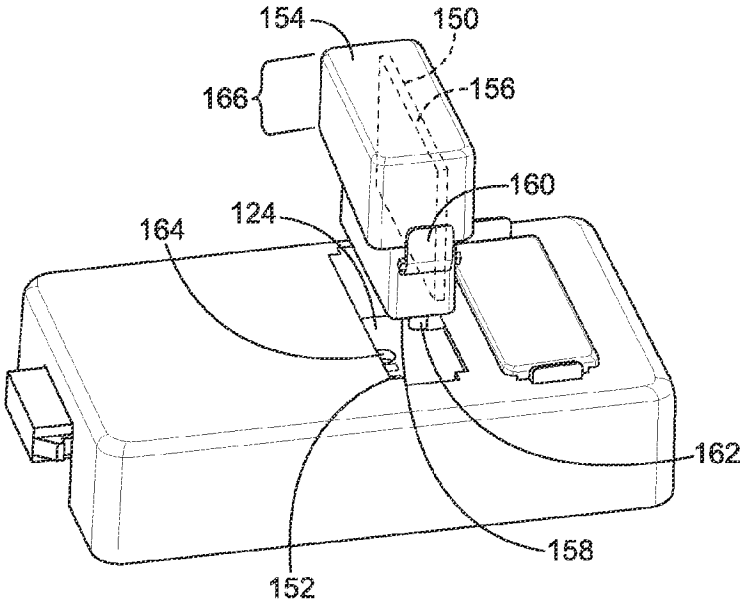
FIG. 4 is a top perspective view of the electronic driver shown in FIG. 3 with an expansion module being mated with the electronic driver.

FIG. 4 is a top perspective view of the electronic driver 120 with an expansion module 150 being mated with the electronic driver 120. In the illustrated embodiment, the cap 136 has been removed from the expansion port 132, thus exposing the driver PCB 124. The driver PCB 124 includes pads 152 aligned with the opening in the top 128 and forming part of the expansion port 132. Alternatively, a connector (not shown) may be terminated to the driver PCB 124 in alignment with the opening in the top 128 for mating with the expansion module 150.

The expansion module 150 includes an expansion module housing 154 in the form of a dielectric body, that encases an expansion module PCB 156 (shown in phantom). The expansion module PCB 156 includes electronic components (e.g. a microprocessor, capacitors, resistors, transistors, integrated circuit, and the like) that create an electronic circuit or control circuit with a particular control function (e.g. wireless control, filtering, light control, and the like). The expansion module 150 may be any one of the expansion modules 62-72 (shown in FIG. 2) having such functionality described above, or the expansion module 150 may be of a different type having desired functionality for the system 10. When the expansion module 150 is mated with the expansion port 132, the electronic driver 120 recognizes the expansion module 150 and the control protocol of the electronic driver 120 is changed based on the functionality of the expansion module 150.

The expansion module housing 154 is sized and shaped to fit into the expansion port 132. The expansion module housing 154 is loaded into the opening in the top 128 such that a mating interface 158 of the expansion module 150 interfaces with the driver PCB 124 (or connector terminated to the driver PCB 124 in such embodiments). The expansion module housing 154 includes latches 160 that secure the expansion module 150 within the expansion port 132. Other types of securing features other than latches may be used in alternative embodiments, such as flanges, fasteners, and the like. In an exemplary embodiment, the expansion module housing 154 includes guide pegs 162 that are received in corresponding holes 164 in the driver PCB 124. The guide pegs 162 orient the expansion module 150 with respect to the expansion port 132 and the pads 152 on the driver PCB 124. The expansion module housing 154 also includes a handle 166 that may be gripped by the installer to remove the expansion module 150 from the expansion port 132, such as to replace the expansion module 150 to change the functionality of the electronic driver 120.

Figure 5:
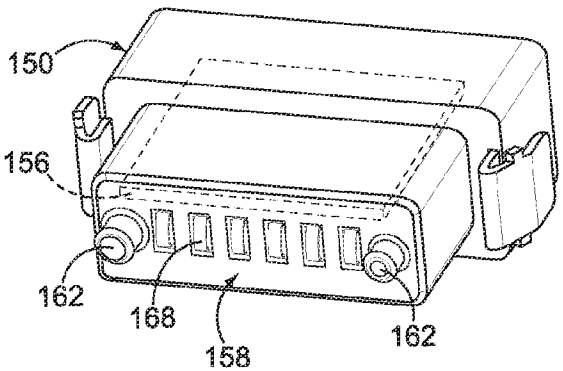
FIG. 5 is a bottom view of the expansion module shown in FIG. 4.

FIG. 5 is a bottom view of the expansion module 150. In an exemplary embodiment, the expansion module 150 includes mating contacts 168 in the form of compliant beams at the mating interface 158. The mating contacts 168 are configured to mate with corresponding pads 152 (shown in FIG. 4) on the driver PCB 124 (shown in FIG. 4). The mating contacts 168 are electrically connected to the expansion module PCB 156 (shown in phantom). The mating contacts 168 form a separable interface at the mating interface 158, such that the expansion module 150 may repeatedly be mated and unmated from the pads 152. The mating contacts 168 are configured to be connected to the pads 152 in a solderless connection.

The expansion module 150 includes two guide pegs 162 at the mating interface 158. Optionally, the two guide pegs 162 may be sized differently (e.g. have different diameters) to operate as polarizing or keying features. For example, the driver PCB 124 may have one hole 164 that is sized too small to receive the larger of the two guide pegs 162. As such, the expansion module 150 can only be oriented in one way within the expansion port 132.

Figure 6:
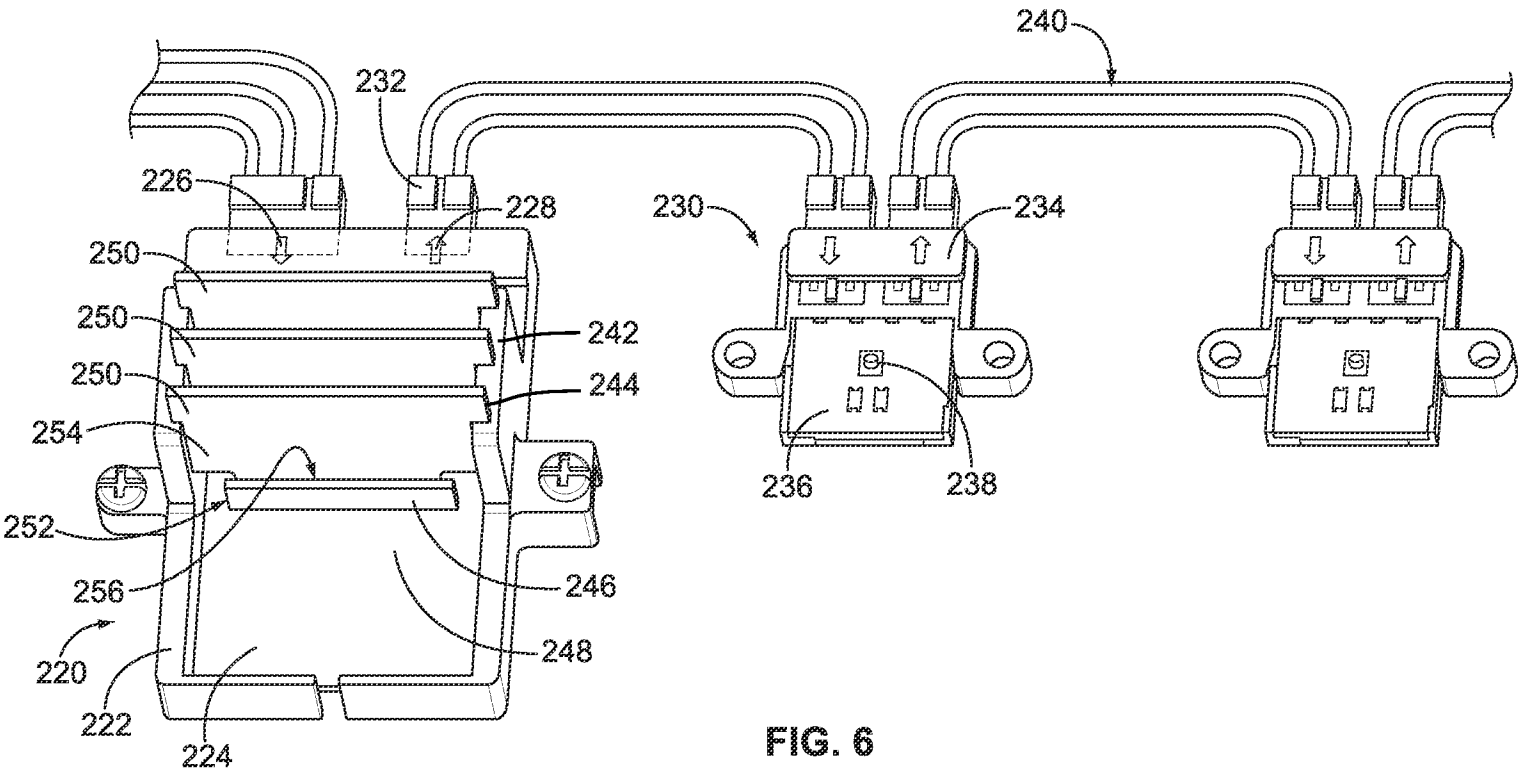
FIG. 6 is a top perspective view of an alternative electronic driver and expansion modules for the solid state lighting system shown in FIG. 1.

FIG. 6 is a top perspective view of an alternative electronic driver 220 and expansion modules 250 for the solid state lighting system 10 (shown in FIG. 1). The electronic driver 220 includes a housing 222 holding a driver PCB 224. The electronic driver 220 has a line in at a power input 226 from the power source 22. The power input 226 is represented by a socket that receives a plug from the line in from the power source 22. Optionally, the plug from the line in may include contacts that engage the driver PCB 224 directly. Alternatively, the plug from the line in may terminate to contacts held by the power input 226, which are then in turn connected to the driver PCB 224. A similar type of socket is provided on the housing 222 to define a power output 228 to supply the power to an LED subassembly 230. For example, a plug 232 is received in the power output 228, which is connected to wires that supply power to the LED subassembly 230.

The LED subassembly 230 includes one or more LED sockets 234 that hold individual LED PCBs 236. Each LED PCB includes one or more LEDs 238. The LED sockets 234 are daisy chained together by wired connectors 240. Any number of the LED sockets 234 may be connected in series. The wired connectors 240 allow the LED sockets 234 to be placed at any position relative to one another in 3D space. The LED sockets 234 are not limited to being positioned in a linear, planar arrangement end-to-end. Rather, the wired connectors 240 may have wires of any length to allow any spacing between the LED sockets 234. The LED sockets 234 may be placed in a linear configuration, a circular configuration, a grid configuration, a stepped configuration in multiple planes, just to name a few.

In an exemplary embodiment, the housing 222 represents a socket that receives the driver PCB 224. The housing 222 includes opposed walls 242 that include a plurality of guide slots 244. The expansion modules 250 are configured to be loaded into the guide slots 244 to mate with the driver PCB 224. In an exemplary embodiment, the driver PCB 224 includes a plurality of connectors 246 mounted to a top surface 248 of the driver PCB 224. In the illustrated embodiment, the connectors 246 represent card edge connectors that receive the expansion modules 250. The guide slots 244 and the connectors 246 cooperate to define expansion ports 252 for the electronic driver 220. The expansion modules 250 are received in the expansion ports 252, and may be removed and/or replaced by other expansion modules 250 having the same or different functionality to change the control protocol of the electronic driver 220. In the illustrated embodiment, the expansion modules 250 are arranged in parallel both mechanically and electrically, however other configurations are possible. Optionally, the electronic driver 220 may include a cover (not shown) that may be coupled to the housing 222 to cover the driver PCB 224. The cover may include openings or slots that are aligned with the connectors 246, which together with the connectors 246 and guide slots 244 define the expansion ports 252.

Each expansion module 250 includes an expansion module PCB 254. The expansion module PCB 254 includes electronic components (not shown) that create an electronic circuit or control circuit with a particular control function. When the expansion module 250 is mated with the expansion port 252, the electronic driver 220 recognizes the expansion module 250 and the control protocol of the electronic driver 220 is changed based on the functionality of the expansion module 250. Optionally, the expansion module 250 may include an expansion module housing, such as a frame surrounding at least a portion of the expansion module PCB 254. The expansion module housing may provide support for the expansion module PCB 254 and/or may provide a gripping surface for removing the expansion module 250 from the expansion port 252. The expansion module PCB 254 includes a mating interface 256 that mates with the connector 246. In the illustrated embodiment, the mating interface 256 is represented by a card edge of the expansion module PCB 254 that is received in the card edge slot of the connector 246.

Figure 7:
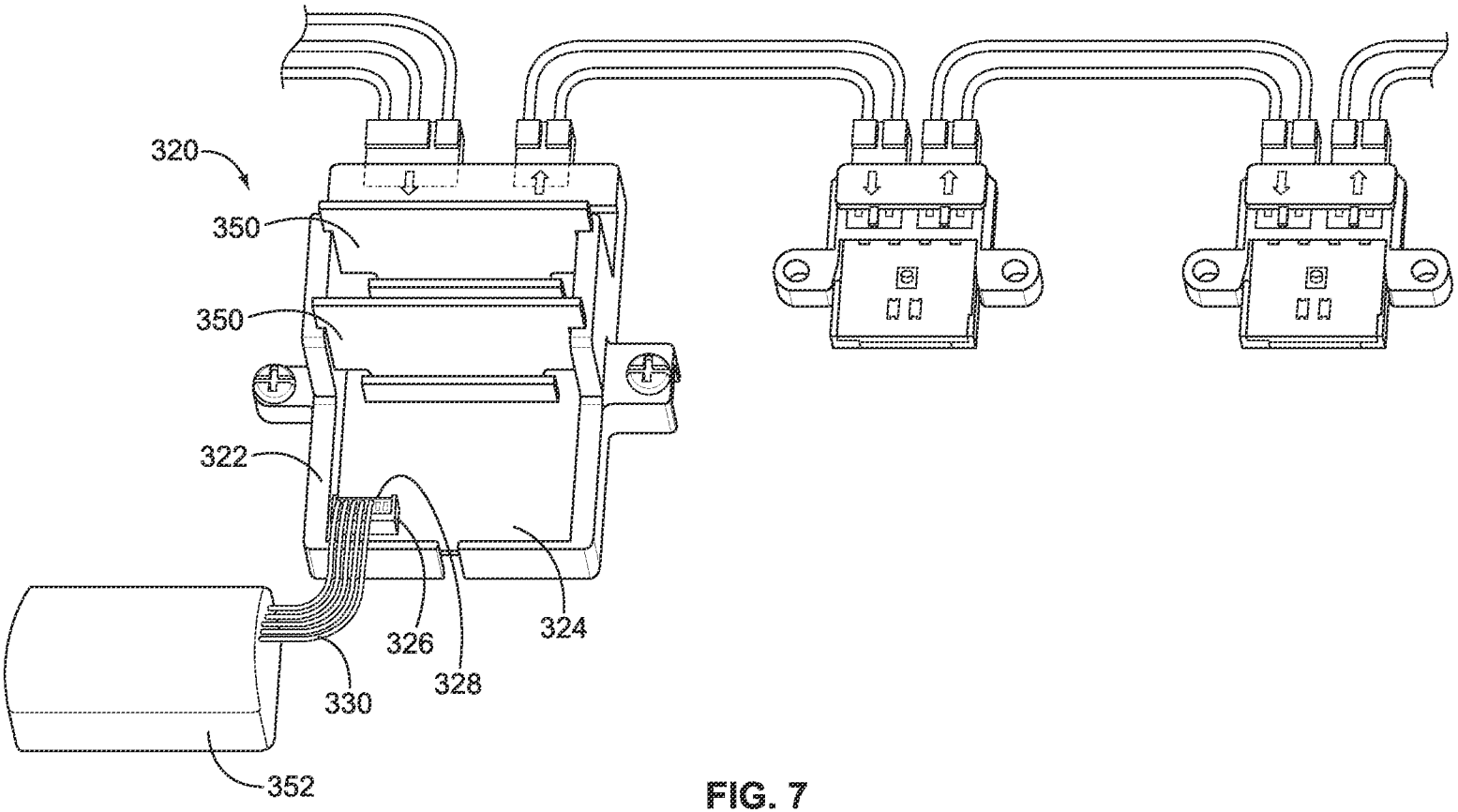
FIG. 7 is a top perspective view of another alternative electronic driver and expansion modules for the solid state lighting system shown in FIG. 1.

FIG. 7 is a top perspective view of another alternative electronic driver 320 and expansion modules 350 for the solid state lighting system 10 (shown in FIG. 1). The electronic driver 320 and expansion modules 350 are similar to the electronic driver 320 and expansion modules 350 illustrated in FIG. 6, however the electronic driver 320 includes an external control module 352 that is separate from the electronic driver 322.

The electronic driver 320 includes a housing 322 and a driver PCB 324. The driver PCB 324 includes a connector 326 mounted thereto. The external control module 352 includes a plug 328 that is mated with the connector 326. The plug 328 is provided at an end of wires 330 routed from the external control module 352. The external control module 352 is positioned separate from the housing 322 of the electronic driver 322. The external control module 352 is not physically connected to or supported by the housing 322. The external control module 352 must be separately mounted to the base 14 and/or heat sink 16 (both shown in FIG. 1), or separately mounted to another structure remote from the base 14 far away from the electronic driver 320.

Figure 8:
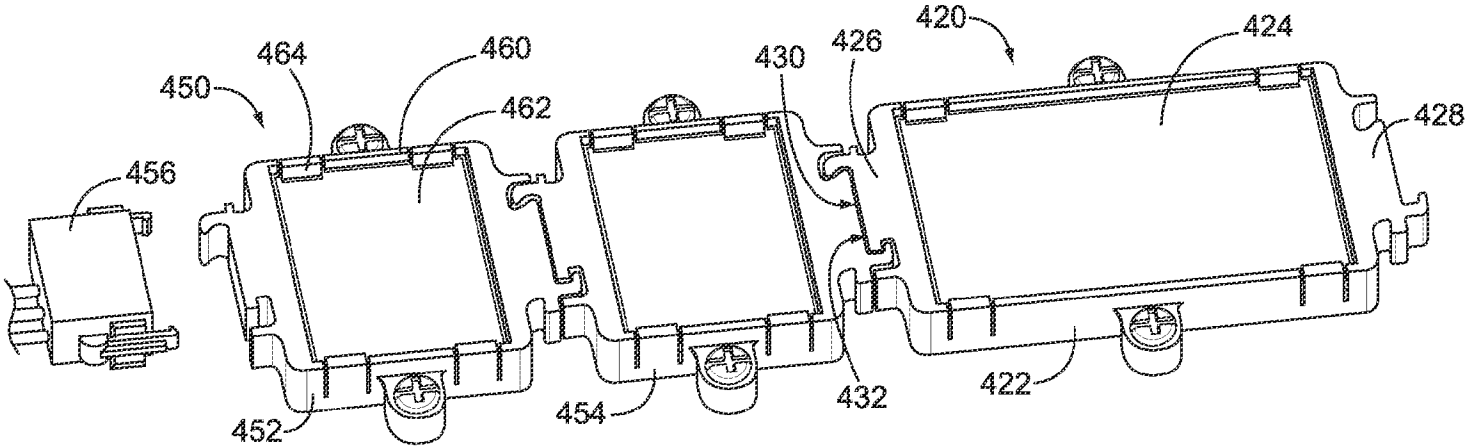
FIG. 8 is a top perspective view of yet another alternative electronic driver and expansion modules for the solid state lighting system shown in FIG. 1.

FIG. 8 is a top perspective view of yet another alternative electronic driver 420 and expansion modules 450 for the solid state lighting system 10 (shown in FIG. 1). The electronic driver 420 includes a housing 422 in the form of a socket that receives a driver PCB 424. The housing 422 includes a power input 426 that receives power through the expansion modules 450, as will be described in further detail below. The housing 422 includes a power output 428 that supplies power to a LED subassembly (not shown).

In an exemplary embodiment, the housing 422 includes an expansion port 430 in the form of a connector at an exterior edge of the housing 422. The expansion port 430 has a separable interface 432 for mating with the expansion module(s) 450. The expansion port 430 also defines the power input 426, wherein the power from the power supply is feed to the electronic driver 420 through the expansion port 430.

The expansion modules 450 are connected to the electronic driver 420 through the expansion port 430. In the illustrated embodiment, the expansion modules 450 are ganged together with the electronic driver 420 and arranged in series upstream of the electronic driver 420. For example, a first expansion module 452 is arranged at an end of the assembly with a second expansion module 454 positioned between the first expansion module 452 and the electronic driver 420. A power connector 456 from the power source is configured to be coupled to an end of the first expansion module 452 opposite the second expansion module 454. Power is routed from the power connector 456 through the first expansion module 452, then through the second expansion module 454, and finally to the electronic driver 420. Any number of expansion modules 450 may be arranged upstream of the electronic driver 420. The expansion modules 450 each have certain functionality, such as filtering, circuit protection, power control, and the like. The types of expansion modules 450 utilized upstream of the electronic driver 420 affect the control protocol of the electronic driver 420. For example, the control protocol may be affected by providing the filtering upstream of the electronic driver 420 or by adding certain functionality such as remote control, dimming, light sensing, and the like upstream of the electronic driver 420.

Each expansion module 450 includes an expansion module housing 460 in the form of a socket that receives an expansion module PCB 462. The expansion module PCB 462 includes electronic components (not shown) that create an electronic circuit or control circuit with a particular control function. When the expansion module 450 is mated with the expansion port 430, either directly or through another expansion module 450, the electronic driver 420 recognizes the expansion module 450 and the control protocol of the electronic driver 420 is changed based on the functionality of the expansion module 450. The expansion module PCB 462 may be held in the expansion module housing 460 by latches 464.

Figure 9:
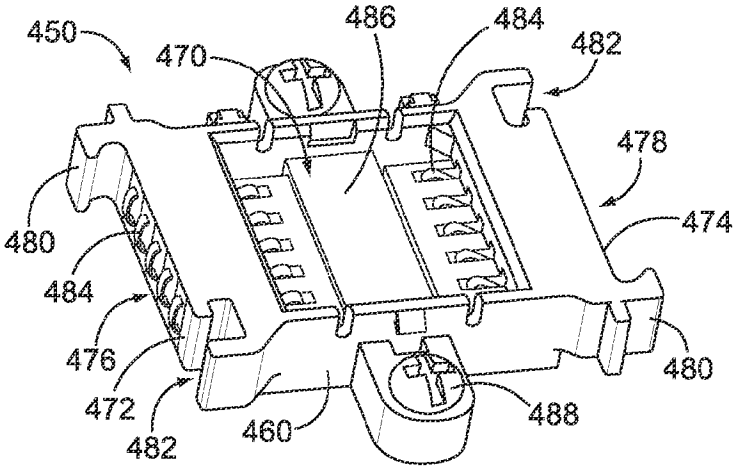
FIG. 9 is a top perspective view of a socket for the electronic driver or the expansion modules shown in FIG. 8.

FIG. 9 is a top perspective view of an expansion module housing 460 for the expansion module 450. In an exemplary embodiment, the housing 422 of the electronic driver 420 (both shown in FIG. 8) may be similar to the expansion module housing 460. The expansion module housing 460 includes a receptacle 470 that is configured to receive the expansion module PCB 462 (shown in FIG. 8).

The expansion module housing 460 includes a first mating end 472 and an opposite second mating end 474. In an exemplary embodiment, the mating ends are hermaphroditic. The mating ends 472, 474 having separable mating interfaces 476, 478, respectively. The mating interfaces 476, 478 may be substantially identical to one another such that the first mating interface 476 is configured to mate with either the first or second mating interface 476, 478 of an adjacent expansion module 450. Additionally, the mating interface is configured to mate with the separable interface 432 of the expansion port 430 (both shown in FIG. 8) of the electronic driver 420. In an exemplary embodiment, the mating ends 472, 474 include hooks 480 on one side thereof and pockets 482 on the other side thereof. The hooks 480 are configured to be received in the pockets 482 of an adjacent expansion module 450.

The expansion module housing 460 includes a plurality of contacts 484 at each of the mating interfaces 476, 478 exposed on the exterior edges of the expansion module housing 460. The contacts 484 extend into the receptacle 470 for mating with the expansion module PCB 462. For example, the expansion module PCB 462 may include pads (not shown) on the bottom side thereof that engages the contacts 484 when loaded into the receptacle 470. The contacts 484 may be compliant beams that deflect when engaging corresponding contacts of an adjacent expansion module, or corresponding contacts in the expansion port 430. The compliant beams may also deflect when mated with the expansion module PCB 462. In an exemplary embodiment, the expansion module 450 includes a heat slug 486 held by the expansion module housing 460. The heat slug 486 is exposed within the receptacle 470 and is configured to thermally engage the expansion module PCB 462 when the expansion module PCB 462 is loaded into the receptacle 470.

The expansion module housing 460 may include fasteners 488 to secure the expansion module housing 460, such as to the base 14 and/or heat sink 16 (both shown in FIG. 1). Once secured, the expansion module PCB 462 may be removed from the receptacle 470 and replaced with a different expansion module PCB having different functionality, such as to change the control protocol of the electronic driver 420.

In an exemplary embodiment, the LED subassembly (not shown) may utilize LED housings similar to the expansion module housings 460 illustrated in FIG. 9. LED PCBs (not shown) may be loaded into the LED housings in a similar manner as the expansion module PCB 462. The LED housings may be connected to the power output 428 (shown in FIG. 8), which includes an interface similar to the mating interfaces 476, 478.

Figure 10:
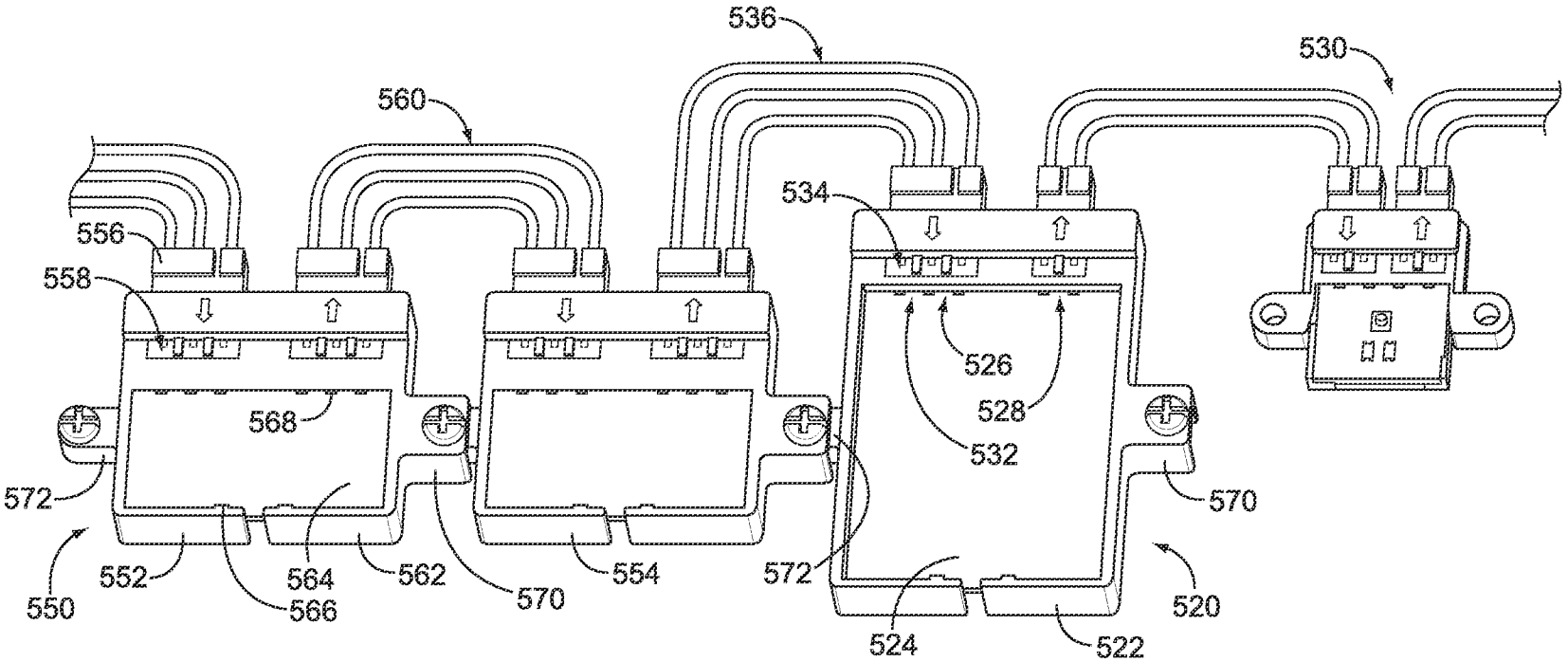
FIG. 10 is a top perspective view of another alternative electronic driver and expansion modules for the solid state lighting system shown in FIG. 1.

FIG. 10 is a top perspective view of another alternative electronic driver 520 and expansion modules 550 for the solid state lighting system 10 (shown in FIG. 1). The electronic driver 520 includes a housing 522 in the form of a socket that receives a driver PCB 524. The housing 522 includes a power input 526 that receives power through the expansion modules 550, as will be described in further detail below. The housing 522 includes a power output 528 that supplies power to a LED subassembly 530.

In an exemplary embodiment, the housing 522 includes an expansion port 532 in the form of a socket at an exterior edge of the housing 522. The expansion port 532 has a separable interface 534 configured to receive a wired connector 536 from the expansion module(s) 550. The expansion port 532 also defines the power input 526, wherein the power from the power supply is feed to the electronic driver 520 through the expansion port 532.

The expansion modules 550 are connected to the electronic driver 520 through the expansion port 532. In the illustrated embodiment, the expansion modules 550 are daisy chained together with the electronic driver 520 and arranged in series upstream of the electronic driver 520. For example, a first expansion module 552 is arranged at an end of the assembly with a second expansion module 554 positioned between the first expansion module 552 and the electronic driver 520. A power connector 556 from the power source is configured to be coupled to a receptacle 558 of the first expansion module 552. Power is routed from the power connector 556 through the first expansion module 552 to a wired connector 560. The wired connector 560 interconnects the first and second expansion modules 552, 554. The power is routed through the second expansion module 554 to the wired connector 536 that is connected to the electronic driver 520. Any number of expansion modules 550 may be arranged upstream of the electronic driver 520, each being interconnected by wired connectors. The expansion modules 550 each have certain functionality, such as filtering, power control, and the like. The types of expansion modules 550 utilized upstream of the electronic driver 520 affect the control protocol of the electronic driver 520.

Each expansion module 550 includes an expansion module housing 562 in the form of a socket that receives an expansion module PCB 564. The expansion module PCB 564 includes electronic components (not shown) that create an electronic circuit or control circuit with a particular control function. When the expansion module 550 is mated with the expansion port 532, the electronic driver 520 recognizes the expansion module 550 and the control protocol of the electronic driver 520 is changed based on the functionality of the expansion module 550. The expansion module PCB 564 may be held in the expansion module housing 562 by latches 566. The wired connectors are terminated to the expansion module PCBs 564, such as to pads 568 at edges of the expansion module PCBs 564. Alternatively, a connector may be mounted to the expansion module housing 562 of the expansion module PCB 564 and the wired connectors may be mated with such connectors.

Each of the expansion module housings 562 are physically connected to the housing 522 of the electronic driver 520. As such, a unitary structure is created between the housing 522 and each of the expansion module housings 562. In the illustrated embodiment, the housing 522 includes ears 570 extending from either side thereof. The expansion module housings 562 similarly include ears 572. The ears of adjacent components are coupled together. For example, one ear may be a male ear and the other ear on the other side may be a female ear. The male ears are plugged into the female ears and secured together using a fastener 574. The fastener 574 may also operate to secure the structures to the base 14 and/or the heat sink 16 (both shown in FIG. 1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A solid state lighting system comprising:

an electronic driver having a housing holding a driver printed circuit board (PCB), the driver PCB defining a driver power circuit thereon, the electronic driver having a power input configured to receive power from a power source and being supplied to the driver power circuit, the electronic driver having a power output connected to the driver power circuit downstream of the power input, the electronic driver controlling the power supply to the power output according to a control protocol, the electronic driver having at least one expansion port defined by the housing and having a separable interface to the driver PCB being electrically connected to the driver power circuit downstream of the power input;

a light emitting diode (LED) subassembly comprising an LED board having at least one LED, the LED subassembly receiving power from the power output of the electronic driver to power the LED;

a first expansion module configured to be coupled to the at least one expansion port of the electronic driver, the first expansion module being configured to be electrically connected to the driver power circuit downstream of the power input, the first expansion module having a first functionality affecting the control protocol; and a second expansion module configured to be coupled to the at least one expansion port of the electronic driver, the second expansion module being configured to be electrically connected to the driver power circuit downstream of the power input, the second expansion module having a second functionality affecting the control protocol;

wherein the first and second expansion modules are selectively coupled to the at least one expansion port to change the control protocol; and wherein the first and second expansion modules have the same form factor and are swappable such that either the first expansion module or the second expansion module are configured to be coupled to any of the at least one expansion port to change the control protocol.

2. The system of claim 1, wherein the at least one expansion port includes a first expansion port, the first expansion module being removable from the first expansion port and the second expansion module being configured to be coupled to the first expansion port after the first expansion module is removed therefrom.

3. The system of claim 1, wherein the first and second expansion modules are capable of mating with the at least one expansion port using a pluggable connection, the first and second expansion modules being configured to be unplugged from the at least one expansion port to be replaced with the other of the first and second expansion modules.

4. The system of claim 1, wherein both the first and second expansion modules are coupled to the at least one expansion port in series with one another.

5. The system of claim 1, wherein both the first and second expansion modules are coupled to the at least one expansion port in parallel with one another.

6. The system of claim 1, wherein the at least one expansion port includes multiple expansion ports each having a different separable interface, the first expansion module being coupled to one of the expansion ports, the second expansion module being connected to a different one of the expansion ports.

7. The system of claim 1, wherein the electronic driver includes a socket, the driver printed circuit board (PCB) received in the socket, the at least one expansion port being defined on an external surface of the socket, the at least one expansion port being electrically connected to the driver PCB across a socket interface between the socket and the driver PCB.

8. The system of claim 1, wherein the electronic driver includes a socket, the driver printed circuit board (PCB) received in the socket, the at least one expansion port being defined by pads on the driver PCB, the first expansion module being coupled to the pads on the driver PCB in a solderless connection.

9. The system of claim 1, wherein the power input is integrated with the at least one expansion port, the power from the power supply being transferred to the electronic driver through at least one of the first and second expansion modules.

10. The system of claim 1, wherein the housing includes multiple expansion ports configured to receive expansion modules therein, the first expansion module being received in a first of the expansion ports and the second expansion module being received in a second of the expansion ports such that the control protocol is affected by both the first and second expansion modules.

11. The system of claim 1, wherein only one of the first and second expansion modules is coupled to the at least one expansion port such that the control protocol is affected by only one of the first and second expansion modules.

12. The system of claim 1, wherein the first expansion module has a first expansion module printed circuit board (PCB) having a first control circuit, the first control circuit defining the first functionality, and wherein the second expansion module has a second expansion module printed circuit board (PCB) having a second control circuit, the second control circuit defining the second functionality, at least one of the control circuits constitutes a filter circuit for filtering a power circuit.

13. The system of claim 1, wherein the first expansion module has a first expansion module printed circuit board (PCB) having a first control circuit, the first expansion module PCB having a connector coupled to the first control circuit and configured to receive a plug from an external device, the external device sending a signal to the first control circuit to define the first functionality.

14. The system of claim 1, wherein the first expansion module has a first expansion module housing and a first expansion module printed circuit board (PCB) held by the expansion module housing, the expansion module housing engaging and being secured to the electronic driver.

15. A solid state lighting system comprising:

an expandable electronic driver having a driver printed circuit board (PCB), the driver PCB defining a driver power circuit thereon, the electronic driver having a power input configured to receive power from a power supply circuit and being supplied to the driver power circuit, the electronic driver having a power output connected to the driver power circuit downstream of the power input, the electronic driver controlling the power supply to the power output according to a control protocol, the electronic driver having a first expansion port having a separable interface being electrically connected to the driver power circuit downstream of the power input;

a light emitting diode (LED) subassembly comprising an LED board having at least one LED, the LED subassembly receiving power from the power output of the electronic driver to power the LED;

a first expansion module capable of being coupled to the first expansion port, the first expansion module having a first expansion module PCB having a first control circuit operatively coupled to the driver power circuit of the driver PCB downstream of the power input by the first expansion port, the first control circuit affecting the control protocol when the first expansion module is plugged into the first expansion port, wherein the first expansion module is removable from the first expansion port such that the first control circuit is not operatively coupled to the driver PCB, wherein the electronic driver is operable in a basic mode when the first expansion module is removed from the first expansion module, and wherein the electronic driver is operable in an enhanced control mode when the first expansion module is coupled to the first expansion port, the control protocol being different in the basic mode and the enhanced control mode; and a second expansion module capable of being coupled to the driver power circuit of the expandable electronic driver downstream of the power input, wherein the first and second expansion modules have the same form factor and are swappable such that either the first expansion module or the second expansion module are configured to be coupled to the expandable electronic driver to change the control protocol.

16. The system of claim 15, wherein the electronic driver includes a second expansion port, the second expansion module capable of being coupled to the second expansion port, the second expansion module having a second expansion module PCB having a filtering circuit affecting the control protocol when the second expansion module is plugged into the second expansion port, the second expansion module being removable from the second expansion port such that the filtering circuit is not affecting the control protocol, wherein the electronic driver is operable in a filtered mode when the second expansion module is coupled to the electronic driver and wherein the electronic driver is operable in an unfiltered mode when the second expansion module is removed from the electronic driver, the control protocol being different in the filtered mode and the unfiltered mode.

17. The system of claim 15, wherein the electronic driver includes a second expansion port, the second expansion module capable of being coupled to the second expansion port, the second expansion module having a second expansion module PCB having a second control circuit operatively coupled to the driver PCB by the second expansion port, the second control circuit affecting the control protocol when the second expansion module is plugged into the second expansion port, wherein the second expansion module is removable from the second expansion port, the control protocol being affected by the presence or absence of the first expansion module and/or the second expansion module.

18. A solid state lighting system comprising:

an expandable electronic driver having a driver printed circuit board (PCB) forming a driver power circuit, the driver power circuit having a power input configured to receive power from a power supply circuit, and the driver power circuit having a power output;

a light emitting diode (LED) subassembly comprising an LED board having at least one LED, the LED subassembly receiving power from the power output of the driver power circuit to power the LED;

a first expansion module capable of being coupled to the driver power circuit of the electronic driver downstream of the power input, the first expansion module having a first expansion module PCB having a filtering circuit being tapped into one of the power supply circuit and the driver power circuit, the first expansion module being removable from the electronic driver such that the filtering circuit is not tapped into either of the power supply circuit or the driver power circuit, wherein the electronic driver is operable in a filtered mode when the first expansion module is coupled to the electronic driver and wherein the electronic driver is operable in an unfiltered mode when the first expansion module is removed from the electronic driver, power characteristics of the driver power circuit being different when the electronic driver is operated in the filtered mode than when the electronic driver is operated in the unfiltered mode; and a second expansion module capable of being coupled to the driver power circuit of the expandable electronic driver downstream of the power input, wherein the first and second expansion modules have the same form factor and are swappable such that either the first expansion module or the second expansion module are configured to be coupled to the expandable electronic driver to change the control protocol.

19. The system of claim 18, the second expansion module having a second expansion module PCB having a control circuit operatively coupled to the driver PCB, the control circuit affecting a control protocol of the electronic driver when the second expansion module is coupled to the electronic driver, wherein the second expansion module is removable from the electronic driver such that the control circuit is not operatively coupled to the driver PCB, wherein the electronic driver is operable in a basic mode when the second expansion module is removed from the second expansion module, and wherein the electronic driver is operable in an enhanced control mode when the second expansion module is coupled to the electronic driver, the control protocol being different in the basic mode and the enhanced control mode.

* * * * *